US008752489B2

(12) United States Patent
Linares

(10) Patent No.: US 8,752,489 B2
(45) Date of Patent: Jun. 17, 2014

(54) LIGHTWEIGHT PALLET AND CONTAINER INCLUDING MESH SUPPORT SURFACE AND GALVANIZED FRAME CONSTRUCTION

(75) Inventor: Miguel A. Linares, Bloomfield Hills, MI (US)

(73) Assignee: Oria Collapsibles, LLC, Auburn Hills, MI (US)

( * ) Notice: Subject to any disclaimer, the term of this patent is extended or adjusted under 35 U.S.C. 154(b) by 36 days.

(21) Appl. No.: 13/433,264

(22) Filed: Mar. 28, 2012

(65) Prior Publication Data

US 2013/0213277 A1 Aug. 22, 2013

Related U.S. Application Data

(60) Provisional application No. 61/599,490, filed on Feb. 16, 2012.

(51) Int. Cl.
*B65D 19/00* (2006.01)
*B65D 19/38* (2006.01)

(52) U.S. Cl.
USPC ..... 108/53.1; 108/57.14; 108/57.32; 108/51.11

(58) Field of Classification Search
USPC ..... 108/51.11, 51.3, 53.1, 53.3, 53.5, 55.1, 108/55.3, 55.5, 56.1, 56.3, 57.14, 57.29, 108/57.3, 57.31, 57.32; 206/386, 595–600
See application file for complete search history.

(56) References Cited

U.S. PATENT DOCUMENTS

| | | | | | |
|---|---|---|---|---|---|
| 974,380 | A | * | 11/1910 | Hoagland | 52/656.7 |
| 1,567,446 | A | * | 12/1925 | McClure | 160/391 |
| 1,934,765 | A | * | 11/1933 | Julien | 228/125 |
| 2,466,226 | A | * | 4/1949 | Gilbertie | 220/4.34 |
| 2,909,348 | A | * | 10/1959 | Averill | 108/53.5 |
| 3,165,110 | A | * | 1/1965 | Brooks | 135/124 |
| 3,227,108 | A | * | 1/1966 | Johnson | 108/53.3 |
| 3,442,231 | A | * | 5/1969 | Jurasek | 108/53.5 |
| 3,596,770 | A | * | 8/1971 | Heinrich | 211/150 |
| 3,831,340 | A | * | 8/1974 | Tulkoff | 53/436 |
| 4,056,195 | A | * | 11/1977 | Keith | 211/153 |
| 4,199,069 | A | * | 4/1980 | Talarico | 211/194 |
| 5,046,546 | A | * | 9/1991 | Benedyk et al. | 160/371 |

(Continued)

FOREIGN PATENT DOCUMENTS

| | | | |
|---|---|---|---|
| DE | 102010035376 | A1 | 3/2012 |
| DE | 102011075266 | A1 | 11/2012 |

(Continued)

*Primary Examiner* — Darnell Jayne
*Assistant Examiner* — Timothy M Ayres
(74) *Attorney, Agent, or Firm* — Gifford, Krass, Sprinkle, Anderson & Citkowski, P.C.; Douglas J. McEvoy

(57) ABSTRACT

The present invention discloses a pallet construction having a body including a plurality of interconnected structural members defining at least an upper support surface, a bottom and a plurality of interconnecting sides. A plurality of stand-offs extend from underside projecting locations of the body in order to elevate the bottom an upward distance from a ground supporting location. A mesh or other sheer material is provided and exhibits durable load carrying and anti-tear properties. The mesh is applied over at least the upper support surface and, in additional variants, along each of the extending side surfaces such that the body establishes a three dimensional volume defining interior. In order to support the mesh, the body includes upper and lower vertically spaced and rectangular perimeter defining members separated by spaced apart and vertically interconnecting members.

3 Claims, 17 Drawing Sheets

(56) References Cited

U.S. PATENT DOCUMENTS

| | | | | |
|---|---|---|---|---|
| 5,233,931 | A * | 8/1993 | McCorkle, Jr. | 108/55.1 |
| 5,647,176 | A * | 7/1997 | Milliken et al. | 52/63 |
| 8,109,402 | B2 | 2/2012 | Hartwall | |
| 2009/0236809 | A1 * | 9/2009 | Carver et al. | 280/43.12 |
| 2012/0074138 | A1 | 3/2012 | Schutz | |
| 2012/0152798 | A1 | 6/2012 | Allegretti et al. | |
| 2012/0240828 | A1 | 9/2012 | Apps et al. | |
| 2012/0261303 | A1 | 10/2012 | Schutz | |
| 2012/0279885 | A1 | 11/2012 | Schutz | |
| 2012/0279898 | A1 | 11/2012 | Schutz | |

FOREIGN PATENT DOCUMENTS

| | | | |
|---|---|---|---|
| JP | 4858712 | B2 | 1/2012 |
| JP | 4924827 | B2 | 4/2012 |
| JP | 4941844 | B2 | 5/2012 |
| JP | 4973861 | B2 | 7/2012 |
| JP | 4973863 | B2 | 7/2012 |
| JP | 2012224399 | A | 11/2012 |

* cited by examiner

LIGHTWEIGHT PALLET AND CONTAINER INCLUDING MESH SUPPORT SURFACE AND GALVANIZED FRAME CONSTRUCTION

CROSS-REFERENCE TO RELATED APPLICATIONS

This Application claims the benefit of U.S. Provisional Application 61/599,490 filed on Feb. 16, 2012.

FIELD OF THE INVENTION

The present invention discloses a variety of pallet designs which exhibit varying combinations of tubular/galvanized construction, including both flat and three dimensional volume holding constructions which are stackable. Selected variants include features such as two way retractable/displaceable wheels. Selected pallet designs exhibit such as lightweight/breathable mesh coverings (i.e. thin film polymer) which are supported upon the tubular members. Additional variants include a tubular framework insert exhibiting any kind of metal, plastic or composite material exhibiting a plastic or closed cellular foam or Styrofoam construction.

DESCRIPTION OF THE BACKGROUND ART

The prior art is documented with various types of load bearing pallets for supporting volumes of cargo. Typical pallet designs include a plurality of individually sized lengths of a board material, such as 2×4 lengths of lumber, which are assembled together in order to construct a generally three dimensional square or rectangular article exhibiting an upwardly spaced and planar load supporting surface. Other prior art pallets incorporate materials other than natural wood according to varying designs and applications.

SUMMARY OF THE INVENTION

The present invention discloses a pallet construction having a body including a plurality of interconnected structural members defining at least an upper support surface, a bottom and a plurality of interconnecting sides. A plurality of standoffs extend from underside projecting locations of the body in order to elevate the bottom an upward distance from a ground supporting location.

In specified variants, a mesh or other sheer material exhibiting durable load carrying and anti-tear properties is provided and is applied over at least one of the support and upwardly extending side surfaces such that the body establishes a three dimensional volume defining interior. In order to support the mesh, the body can be constructed with upper and lower vertically spaced and rectangular perimeter defining members separated by spaced apart and vertically interconnecting members. The mesh can be constructed from such as, without limitation, a polymeric plastic film and is further constructed as either a plurality of individual sheet sections or a single section secured to locations along the upper support surface and vertically extending sides in order to provide a stretched/tautened condition in use for supporting such as volumes of loose articles including fruits, vegetables or other items.

Additional variants include the provision of snap in receiving channels and insert rods for securing either or both of inner and perimeter extending edge portions of the mesh covering material in order to mount said material in a tautened and load supporting fashion. An alternate mesh mounting/tautening arrangement includes configuring the mesh with at least one elongated and sewn or otherwise joined loop edge within which is inserted a first inner tube. The first tube is in turn fed within a larger diameter and interiorly hollow outer tube establishing a structural side or reinforcing interior location of the body. The outer tube includes a channel edge for receiving and guiding the mesh material during insertion of the inner tube.

The stand-offs further can be configured as circular supports defining cage subassemblies, at least a corner sub-plurality of which incorporate vertically actuating casters. A lever and linkage mechanism vertically and simultaneously displaces each of the corner located casters via a slaved rotation interface established between an upper stem supporting portion and a rotating disk portion. Additional features include the standoffs extending in an incrementally inwardly angled fashion relative to an outer perimeter defining edge of the body in order to facilitate multiple stacking of the bodies.

Other variants include at least one of an injection molded plastic, closed cellular or other plasticized composite applied over the body. Additional features include the provision of forklift receiving apertures configured within the body and accessible from some or all of the interconnected sides.

BRIEF DESCRIPTION OF THE DRAWINGS

Reference will now be made to the attached drawings, when read in combination with the following detailed description, wherein like reference numerals refer to like parts throughout the several views, and in which.

DETAILED DESCRIPTION OF THE PREFERRED EMBODIMENTS

Figure 1:
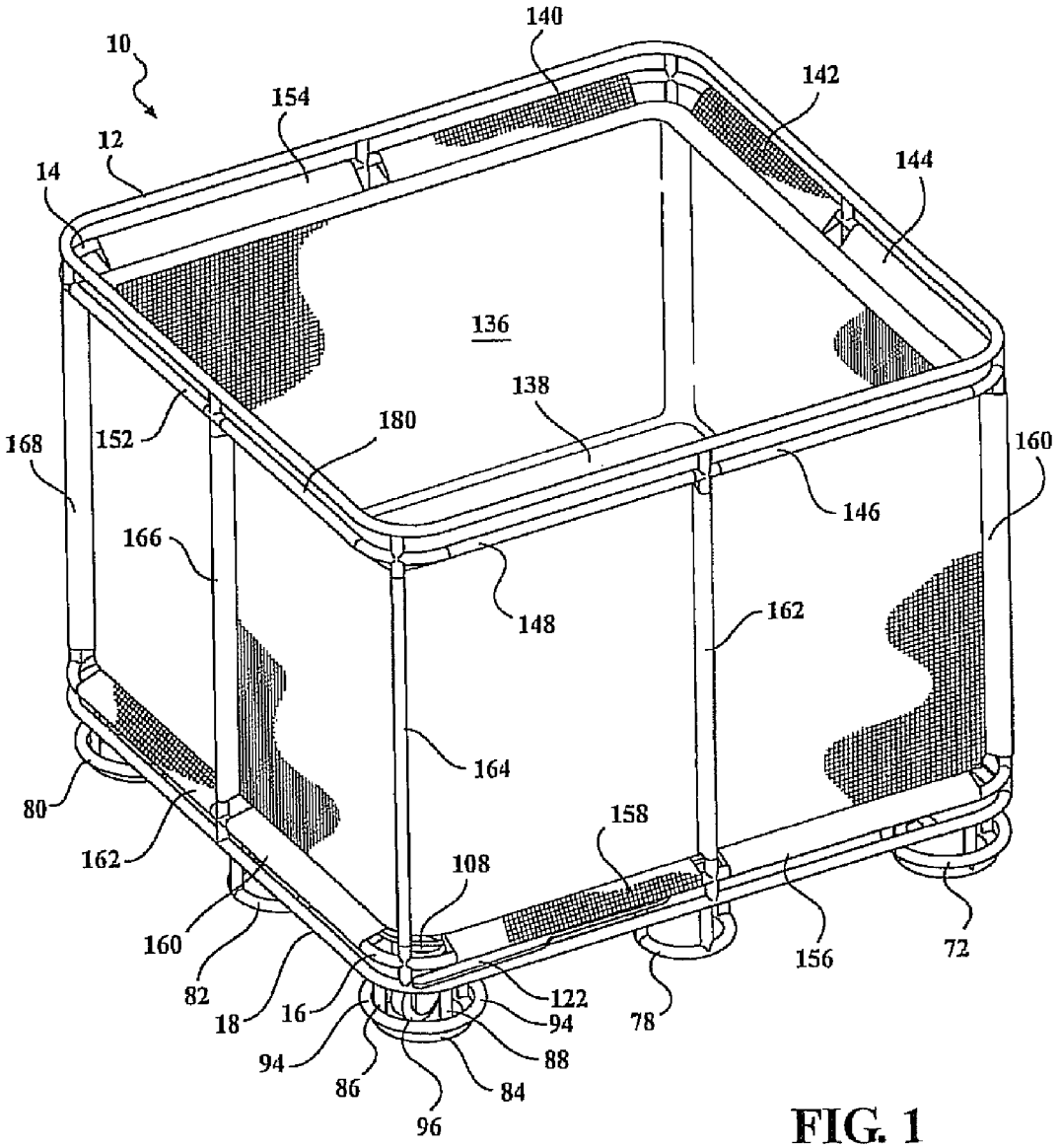
FIG. 1 is a perspective view of a stackable and volume defining pallet bin exhibiting a tubular rectangular body and tautened mesh covering.
Figure 2:
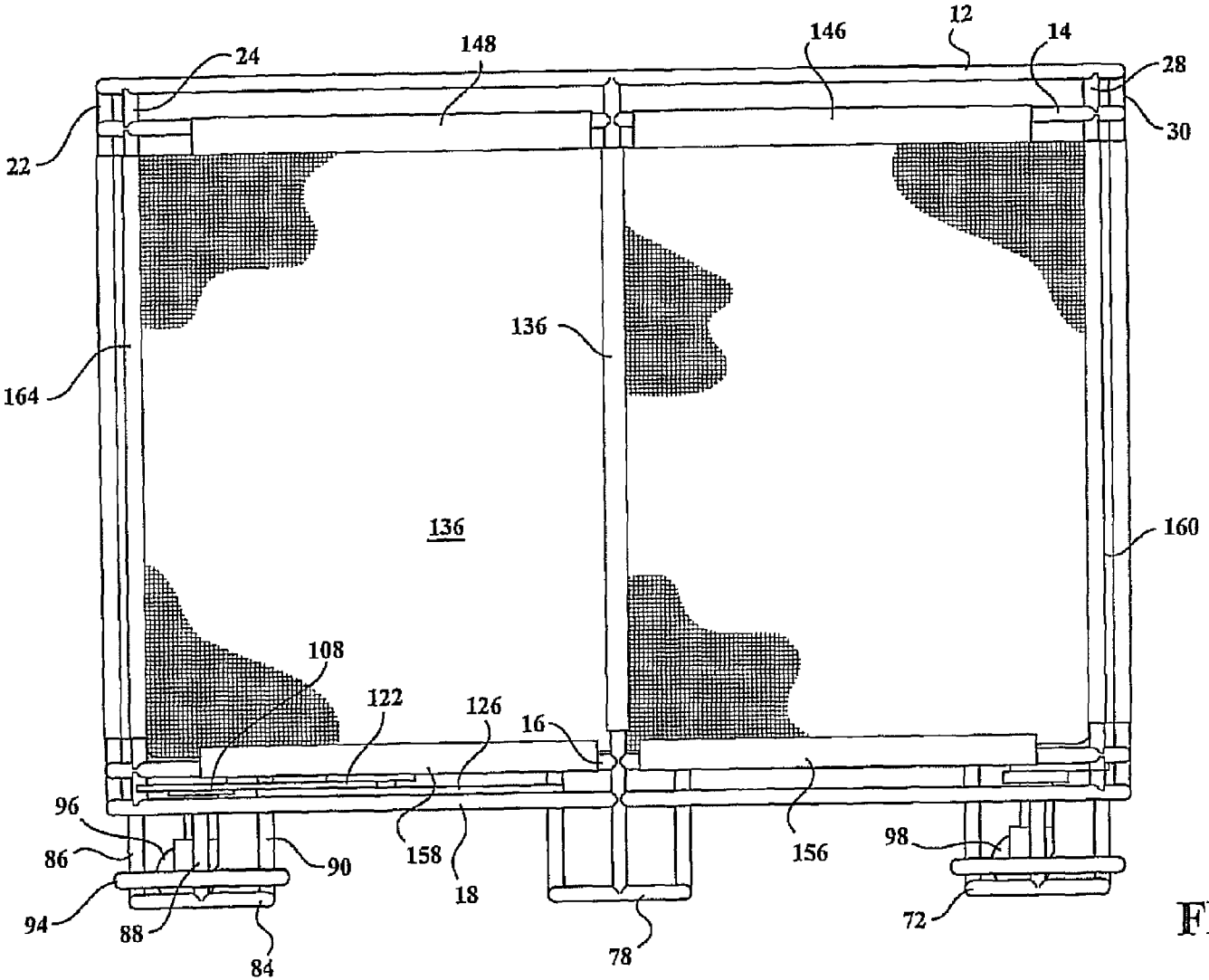
FIG. 2 is a side view of the pallet bin and illustrating the pedestal stand-offs and corner located vertically displaceable casters.

With reference now to FIGS. 1-7, a first variant of a lightweight stackable pallet is described and which is generally illustrated at 10 in the assembled perspective view of FIG. 1. The variant 10 depicts a stackable and volume defining pallet bin, such as which is capable of supporting any type of good or article not limited to edibles or other loose or packaged articles and which benefit from the ventilation and breatheability aspects provided for by the sections of enclosure defining and tautened mesh coverings mounted to the pallet skeleton and as will be subsequently described.

Figure 3:
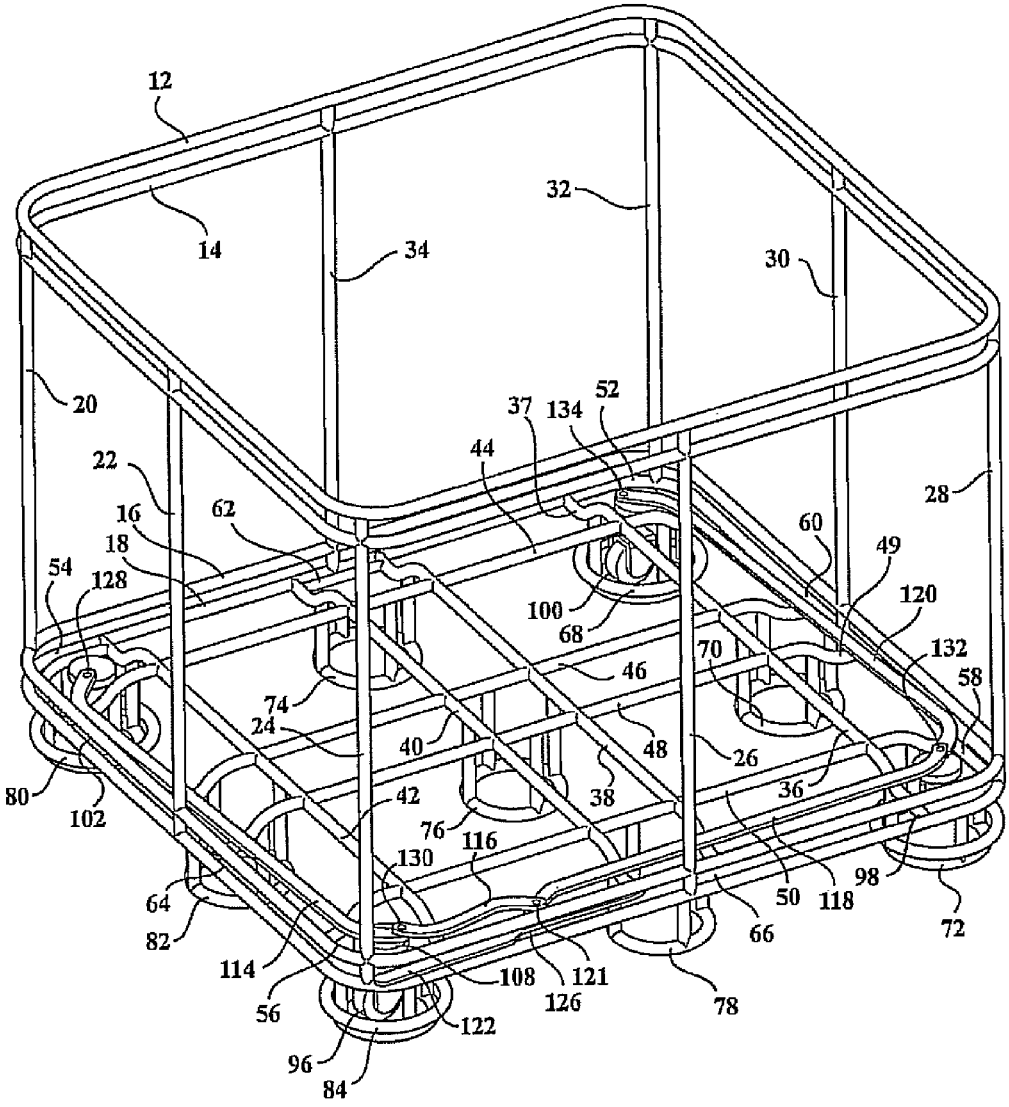
FIG. 3 is a perspective view similar to FIG. 1 with the mesh covering removed and better illustrating the structural aspects of the pallet bin.

As additionally shown in the corresponding and naked structural perspective of FIG. 3 (with mesh sections removed) the body of the pallet bin is constructed of a skeleton make up of a plurality of interconnecting structural members not limited to sections of galvanized pipe, other metal, or composite plastic tubing. In the non-limiting variant depicted, these include being configured into a rectangular four sided and depth defining structure with a pair of upper closely vertically spaced and four sided (rectangular) perimeter defining tubular members 12 and 14, as well as a further pair 16 and 18 of closely spaced lower four sided members.

The upper 12 & 14 and lower 16 & 18 pairs of rectangular perimeter defining members are interconnected (such as by welding in the instance of galvanized steel and/or other metals or, in the further instance of polymer and like composites, by injection molding) by spaced apart vertically extending and height/depth establishing members 20, 22, 24, 26, 28, 30, 32 and 34 (as best shown in FIG. 3 with the mesh covering removed). The lower pair 16 & 18 of rectangular perimeter defining members are supported an elevated distance above a ground support surface (see also side view of FIG. 2) by the incorporation into the assembly of a plurality of pedestal stand-off locations, these including in the illustrated embodiment additional welded, cast or injection molded portions which are integrally formed with a base surface defined interiorly of the lower pair 16 & 18 of perimeter members and extending downwardly therefrom, as again best shown in reference to FIG. 3.

Specifically, the base surface of the pallet bin is collectively defined by pluralities of two dimensional grid spaced and extending base members, see first plurality of members 36, 38, 40 and 42 and second crosswise extending plurality of members 44, 46, 48 and 50. Additional corner rounded "L" portions 52, 54, 56 and 58 are provided in proximal inwardly spaced fashion from lower rounded corner edges of the lowermost perimeter member 18, and to which perimeter edge locations associated with intersecting pairs of grid members 36/44, 36/50, 42/44 and 42/50 are additionally joined. The upward support surface defined by members 36, 38, 40, 42 and additional intersecting and grid defining members 52, 54, 56 and 58 can be slightly elevated by virtue of angular stepped edge mounting locations, such as extending from the outer supporting/perimeter defining member 18 and representatively depicted at 37 for selected elongated member 36 and further at 49 for selected intersecting member 48

Additional bracing of the sides is further provided by edge proximate extending sections 60, 62, 64 and 66, these intersecting each of four edge proximate locations associated with X shaped intersecting members 38/40 and 46/48. Beyond that depicted, it is understood that the base surface and grid defining members 36, 38, 40, 42, 44, 46, 48 and 50 can any curved or angled outer perimeter contacting geometry, such as again associated with the selected lower perimeter defining portion 18, and such that the co-planar middle sections of the grid portions collectively establish either a raised (as shown) or lowered support surface.

The standoff locations depicted include a plurality (such as nine shown) of equidistantly spaced circular and open interior pedestal supports, see as shown at 68, 70, 72, 74, 76, 78, 80, 82 and 84, and which (as best shown again in FIG. 2) are downwardly spaced from intermediate or corner proximate and braced locations of the grid defining pairs and outer most perimeter member 18 previously described. A plurality of four vertical standoffs, see as shown by selected example of standoffs 86, 88, 90 and 92 associated with selected circular bottom support 84, are provided for each of the pedestal supports and as is depicted in enlarged fashion in FIG. 4 (for purposes of ease of illustration the remaining sets of vertical standoffs associated with the other eight circular pedestal supports are evident but not separately referenced).

Figure 4:
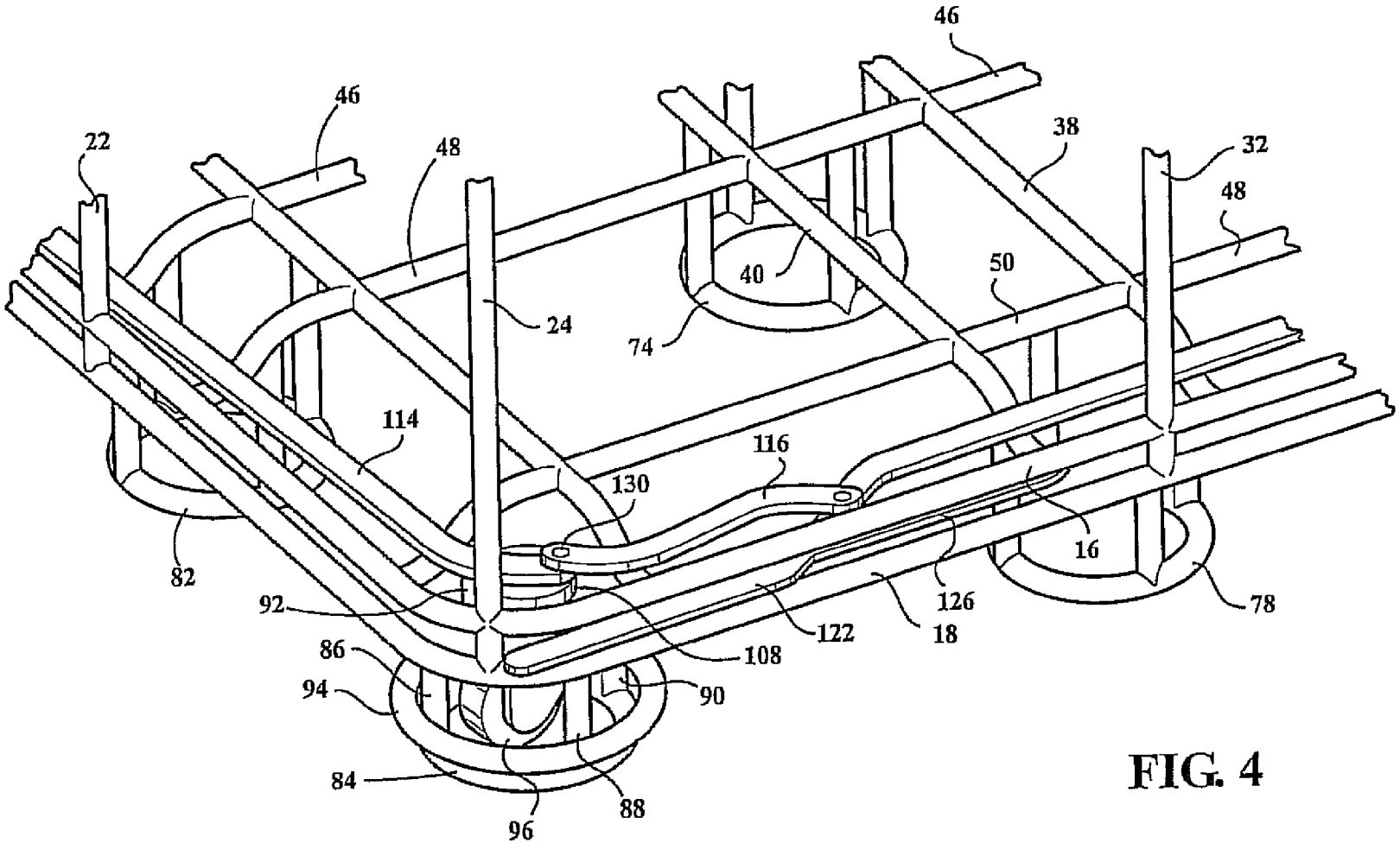
FIG. 4 is an enlarged bottom partial view of a corner location of the pallet bin and better depicting the pivot lever for facilitating simultaneous downward displacement of the corner located casters.
Figure 5:
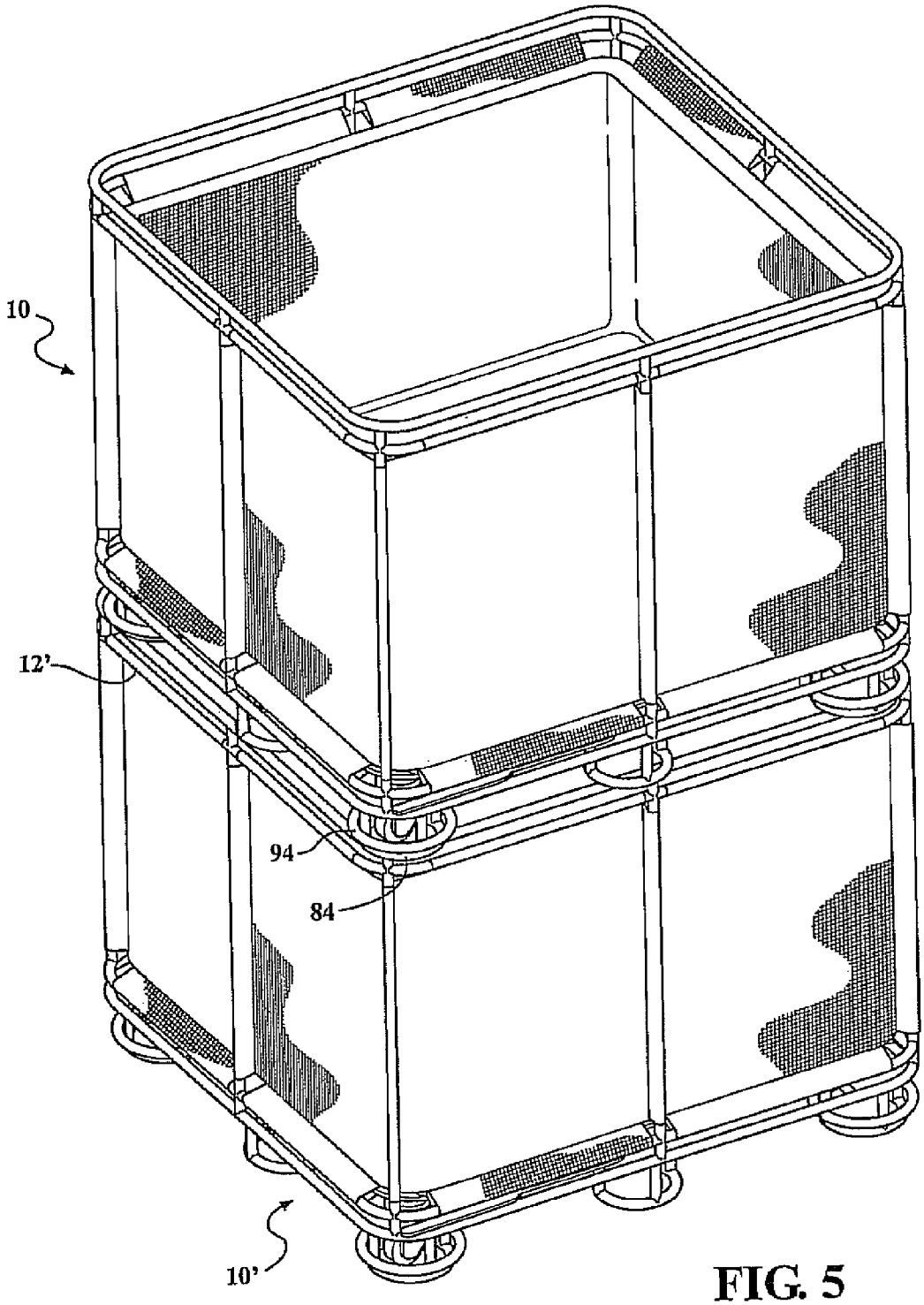
FIG. 5 is a plural stackable perspective of the pallet bin.

A secondary circular brace is also depicted at each corner location (see as further shown by brace 94 in FIG. 4 which is arranged slightly above the lower-most circular bottom support 84 as well as concentrically welded or joined to the outward side of the standoffs 86, 88, 90 and 92), this such as in order to provide additional structural integrity to the assembly as well as to permit multiple stack-ability (as further depicted in FIG. 5 which depicts the arcuate edge ledge support established between the lower/smaller diameter circular portion 84 and the upper/larger and outer concentric/diameter circular portion 94, the four corner locations collectively creating corner supports which enable an upper pallet bin 10 (FIG. 5) to be securely supported upon a lower bin 10', again by virtue of tire uppermost perimeter edges of rectangular extending portion 12' defining an engaging lip which supports thereupon the four corner underside ledges established by the double ring 84/94 construction at each corner pedestal standoff location associated with each pallet bin.

Figure 6:
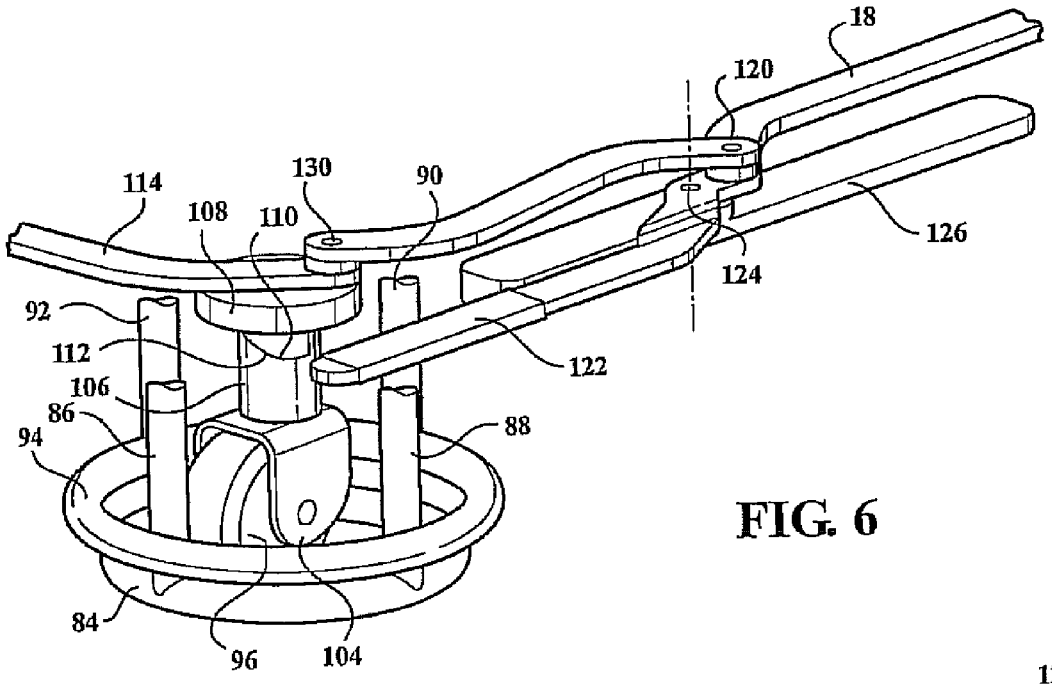
FIG. 6 is a partial perspective of a selected corner caster in a first retracted position.
Figure 7:
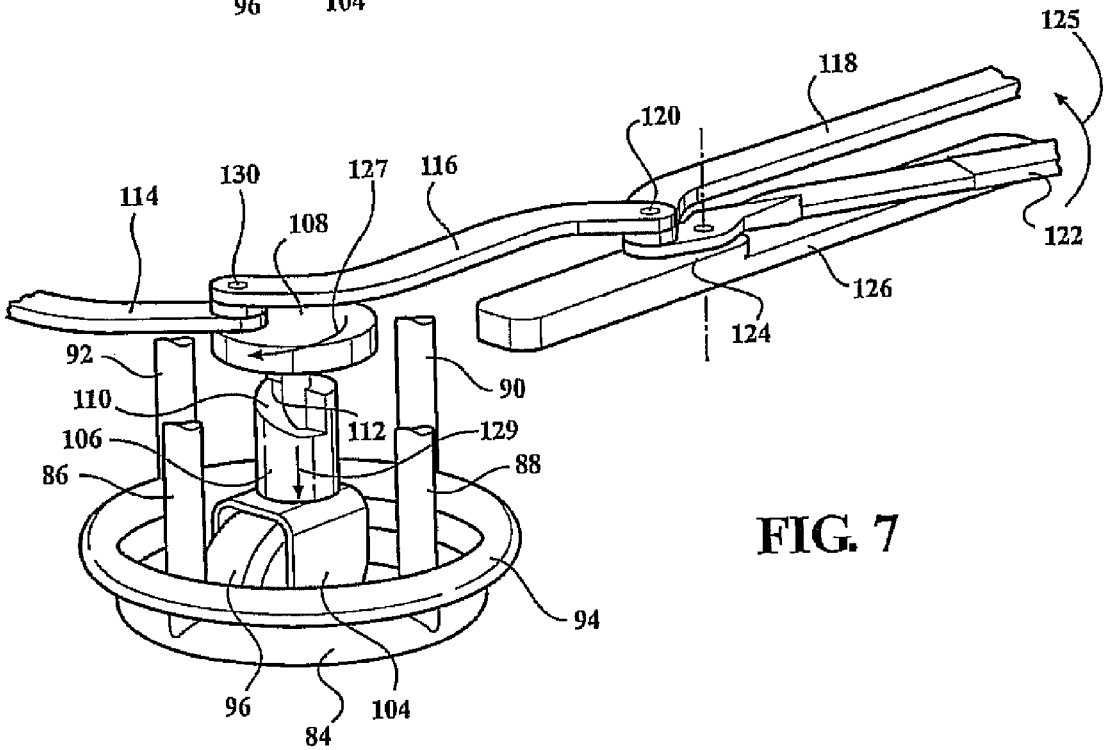
FIG. 7 is a succeeding illustration with the lever rotated to an actuating position in which the caster is caused to simultaneously rotate and downwardly displace relative to an outer structurally supporting cage defining a fixed standoff.

Referring again to FIG. 4, in combination with succeeding FIGS. 6-7, illustrates a mechanism for selectively vertically extending ox retracting a plurality of four corner supported casters 96, 98, 100 and 102 (FIG. 2) which are supported within the open vertically extending interior volumes defined by each of the corner situated circular bottom supports 68, 72, 80 and 84. For purposes of ease of illustration. FIG. 4, in combination with FIGS. 6-7 depicts selected corner located caster 96 associated with circular corner bottom support 84. The caster 96 is rotatably relative to a lower bracket portion 104 with spaced apart sides and which includes an upper extending stem 106 in turn rotatably and vertically inter-displaceable relative to an uppermost circular disk 108 which defines a braced elevated edge support of the pallet bin.

As further best shown in FIGS. 6-7 circular ramp surfaces are established between the upper profile of the castor supporting stem 106 (at 110) and the lower profile of the interiorly braced disk 108 (at 112). As further shown in FIGS. 3-4 in combination with action views FIGS. 6-7, an actuating linkage is depicted for providing two-way vertical extension/retraction of the casters 96, 98, 100 and 102 between refracted positions within the bottom circular standoff supports (FIG. 6) and downwardly extended positions (FIG. 7) in which the bottom roller surface of the caster (see as shown at 96) projects beyond the bottom rim surface of the selected circular pedestal standoff shown at 84, and thereby permits the pallet bin to be easily transported along a ground surface.

As shown, the linkage mechanism, includes a plurality of pivotally edge interconnecting and horizontally extending links 114, 116, 118 and 120 (see as best shown in FIG. 3) and by which the links collectively extend along three of the four enclosed perimeter defining sides of the pallet bin base. As further shown, selected link 114 pivotally connects at its opposite ends with uppermost displacing locations of casters 102 and 96, whilst opposite and parallel edge spaced link 120 likewise pivotally connects at its opposite ends with further selected corner casters 98 and 100.

Collective actuation of the outer caster supporting links 114 and 120 is provided by an additional pair of interconnecting links provided by link 116 (pivotally interconnected with link 114 at a vertically axial offset and rotational inducing location associated with selected caster subassembly 96) and by link 118, which interconnects at a remote end in similar fashion to selected caster 98 and which further hingedly connects to link 116 at a further axial location 121. Without elaboration, each remote linkage connecting location establishes a similar eccentric rotational relationship in order to induce separation and coasting rotation of the spiraling profiles 110 and 112 established between the caster stem 106 and fixed disk 108 interfaces.

An elongated handle 122 is provided and includes, at a base end opposite a remote extending and handle gripping end, a pivot linkage axis 124 (see as best shown in FIGS. 6 and 7) defined with a structural, supporting member 126 which in turn can be fixedly supported in extending fashion, relative to an extending edge of the lowermost perimeter extending portion 18 (see FIG. 4). As further shown, an offset end location of the handle 122 is coaxially established with the pivot location 120 established between the links 116 and 118 and such that upon pivoting the handle from the position depicted in FIG. 6 to that subsequently shown in FIG. 7 (see arrow 125 in FIG. 7), a rotational driving force is transferred in opposite directions to each of the links 116 and 118, and thereafter to the opposite end interconnecting links 114 and 120, in order to concurrently rotated each of the caster subassembly disk supports (again in reference to disk 108 in FIG. 7).

The structural relationship between the disk 108 and underside stem 106 of the caster support is such that the stem is supported in rotatively opposing and vertically inter-displaceable fashion and so that a rotational force exerted to the corner disposed disks (such as shown by arrow 127 for disk 108) causes the spiraling opposing surface 110 of the caster support stem 106 to separate from the opposing pattern 112 of the disk 108 underside (see linear arrow 129), causing the caster 96 to downwardly displace so that its bottom roller supporting portion projects underneath the circular underside perimeter of the circular pedestal support 84. As shown, this is assisted by eccentric pivot connections 128, 130, 132 and 134 defined at selected interfacing locations of linkage arms 114, 116, 118 and 120 in relation to each of the rotatably slaved disks associated with each caster subassembly. Beyond the configuration of the handle 122 depicted, it is understood that other and additional linkage constructions can be employed and which enable fast and convenient two way vertical extension/retraction of each caster supporting stem or post relative to a structurally reinforced and fixed location defined in vertically recessed fashion relative to corner underside locations of the pallet bin.

Referring again to FIGS. 1-2, a series of configured mesh sections are provided which mount along extending locations of the structural supports of the pallet bin in tautened fashion, and in order to establish the volume defining interior. The mesh sections can include, in one non-limiting application, any type of sheer or finely woven or cast film of polymeric material, such as which mimics the properties of a durable and breathable cloth (and such as which could be substituted without departing from the inventive scope). As shown, the mesh sections can further exhibit any of a sheer, partially or substantially transparent or translucent appearance, such as which provides a desired degree of exterior view-ability of the inner supported cargo contents). It is also envisioned and understood that, depending upon the intended cargo, a durable metal or plastic chicken wire construction could be substituted for the mesh weave.

Without limitation, the mesh can be provided as any number of individual sections and which are representatively depicted in FIG. 1 as a four sided (and perimeter defining) mesh section 136 (can include one or more end-to-end connected pieces) along with a further mesh base section 138. A plurality spaced and horizontal upper edge extending looped portions 140, 142, 144, 146, 148, 150, 152 and 154 are depicted associated with the collectively defined mesh section 136 and which are supported upon perimeter extending locations of the lower closely spaced perimeter defining portion 14 as shown, this in combination with additional lower edge looped portions (only some of which are apparent in FIG. 1 at 156, 158, 160, 162, et seq.) and additional vertical and exterior edge extending looped portions, a subset of which are further representatively depicted at 160, 162, 164, 166, 168, et seq., and which mount over selected vertical structural supporting members 20-34. Although not clearly shown, assembly of the mesh weave sections can be facilitated by the addition of any of zippers, button and snap, inter-engaging hook and loop (Velcro) or other structure intended to quickly and structurally securely inter-assemble any required number of mesh sections with the associated horizontal and vertical structural support locations of the pallet bin such as is shown.

Figure 8:
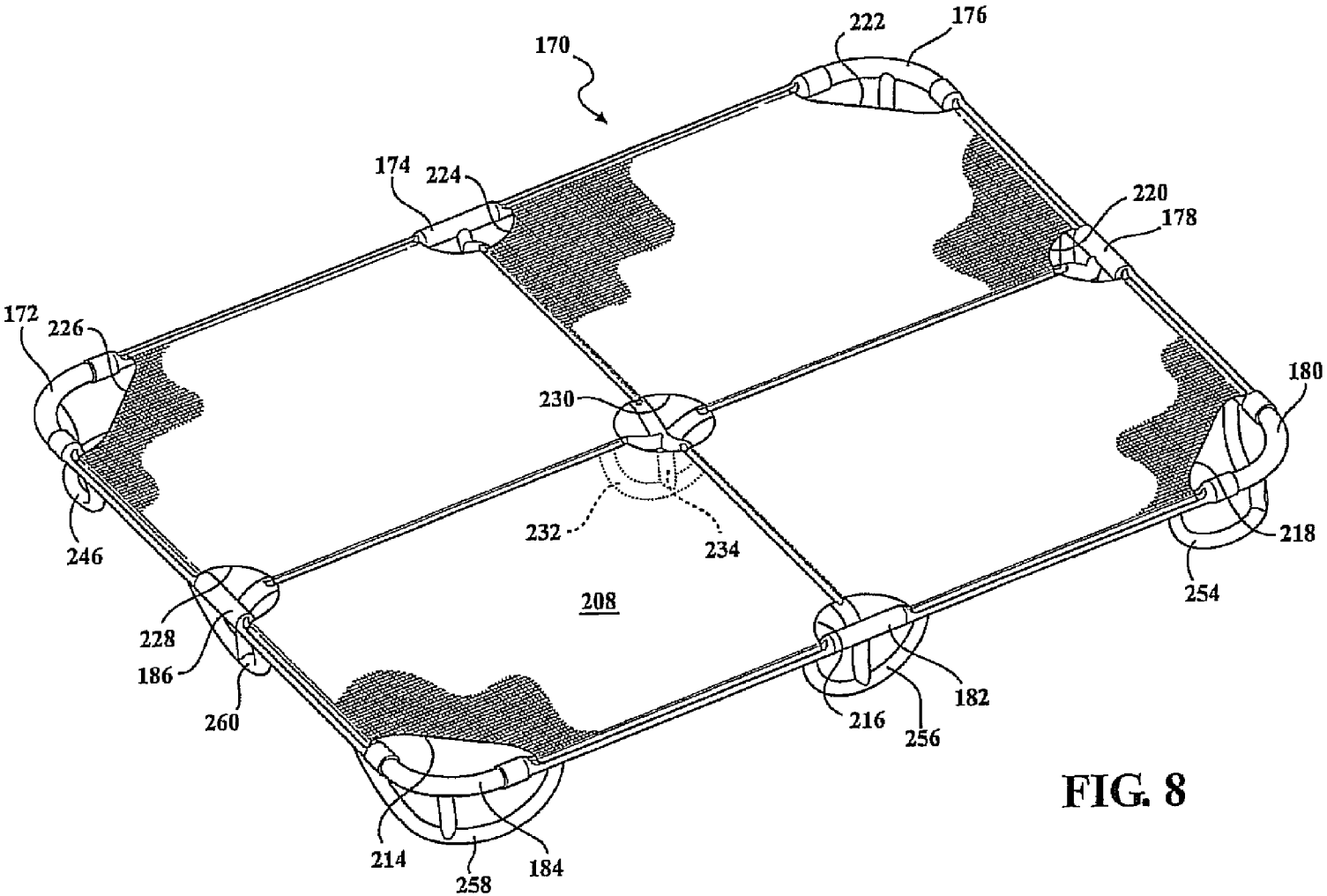
FIG. 8 is a perspective view of a further variant of pallet exhibiting a substantially flattened and mesh supporting surface with corner and middle located standoff supports.
Figure 9:
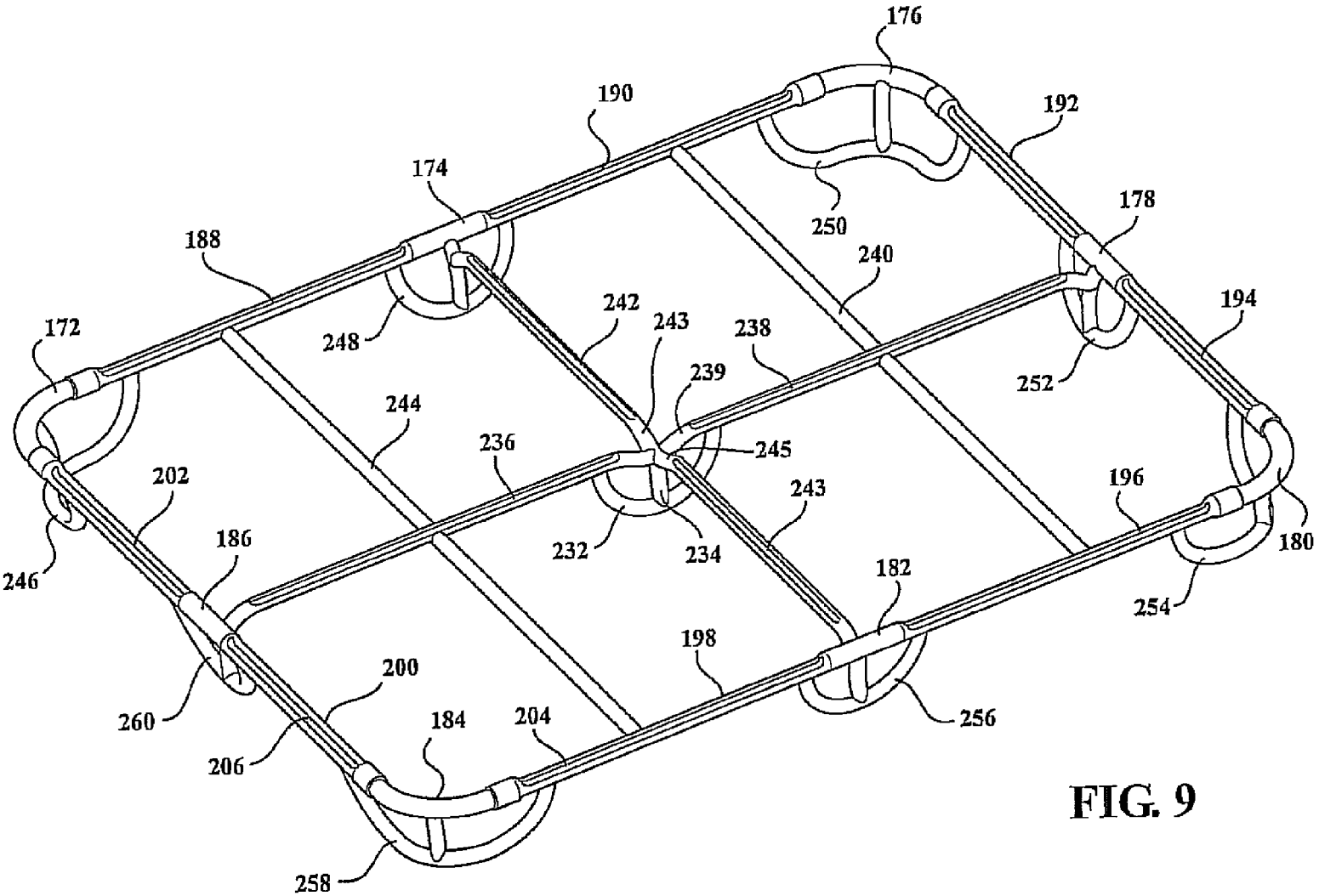
FIG. 9 is a skeletal depiction similar to FIG. 8 with mesh covering removed.

Proceeding to FIG. 8, a perspective view is generally shown at 170 of a further variant of pallet which is similar in many respects to that previously described and exhibits a substantially flattened and trampoline style appearance without the depth defining sides of the prior embodiment. As further shown in FIG. 9, the skeletal substructure of the pallet again includes an interconnecting arrangement of galvanized or like elongate members including an outer pseudo-rectangular and rounded edge perimeter defining profile exhibiting corner and intermediate gripping portions 172-186 which alternate with linear extending portions 188-202.

Figure 10:
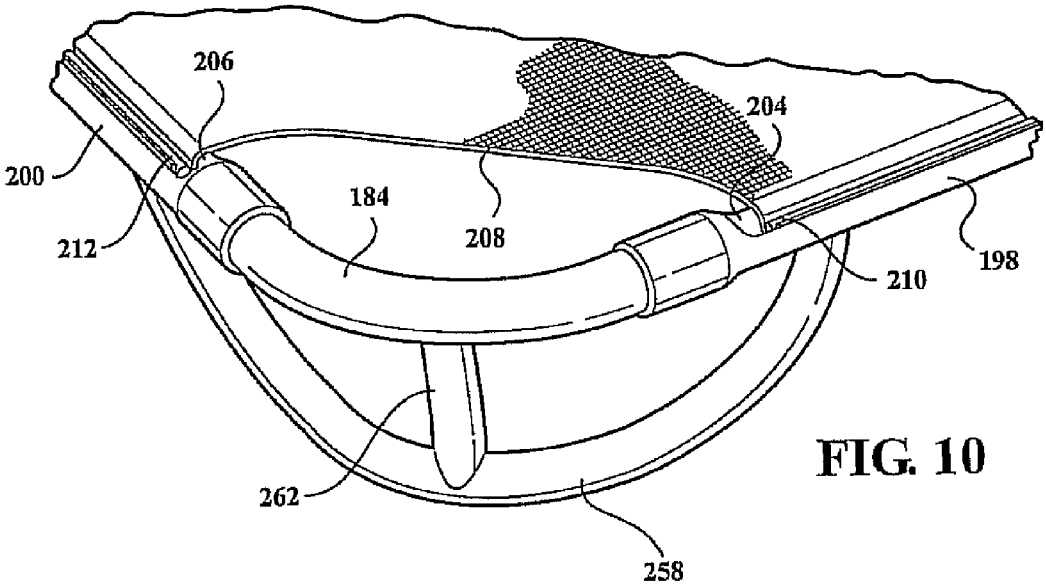
FIG. 10 is an enlarged corner partial view better depicting the tubular construction of a selected corner standoff support along with the tautening configuration provided by the insert rods and configured snap-in channels defined along the extending upper edge surfaces of the pallet sides and ends in order to pinch overlaying edge locations of the mesh material.

Each of the linear extending portions 188-202 includes, along upper communicating and linear extending edges, a recessed and substantially cylindrical cross sectional profile (see as depicted in enlarged corner partial view FIG. 10 by first cylindrical recessed surface communicable profile 204 depicted within linear portion 198 and further profile 206 depicted within linear portion 200). A substantially rectangular shaped mesh layer 208 is provided and includes configured edge extending ends, the outermost portions of which are seated in the inner looped manner depicted in FIG. 10 and prior to receiving snap-fit dimensioned and elongated rods 210 and 212 in the manner shown such that the mesh material 208 (such as including any of those previously described in the preceding variant) is pinched in restrained fashion within the edge extending recessed profile of the outer perimeter in order to mount the mesh material in a tautened fashion.

The four sided mesh 208 exhibits arcuate recessed outer intermediate and edge locations (see reinforced inwardly arcuate perimeter edges at 214, 216, 218, 220, 222, 224, 226 and 228 in alignment with each, of the alternating corner and mid-point gripping locations 172, 174, 176, 178, 180, 182, 184 and 186) along with an additional and inner circular recess perimeter 230 which reveals an intermediate support location (see arcuate rounded underside pedestal 232 connected at opposite ends and at an intermediate support 234 to locations associated with subset lengths 236 and 238 of an inner extending structural support. As further shown in FIG. 9, additional crosswise extending supports include those at 240, subdivided at 242/243 and further at 244 and which are provided at spaced intervals along the longer sides in interconnecting fashion with the centrally joined sections 236 and 238 extending between the shorter rectangular perimeter defined sides. As shown, additional surface exposed and linear extending recess profiles are defined in the subsections 236 and 238 and which, in combination with the outer linear extending recess profiles, engage additional and interior extending locations of the mesh 208 (again FIG. 8) in order to present an overall flush appearance.

Figure 11:
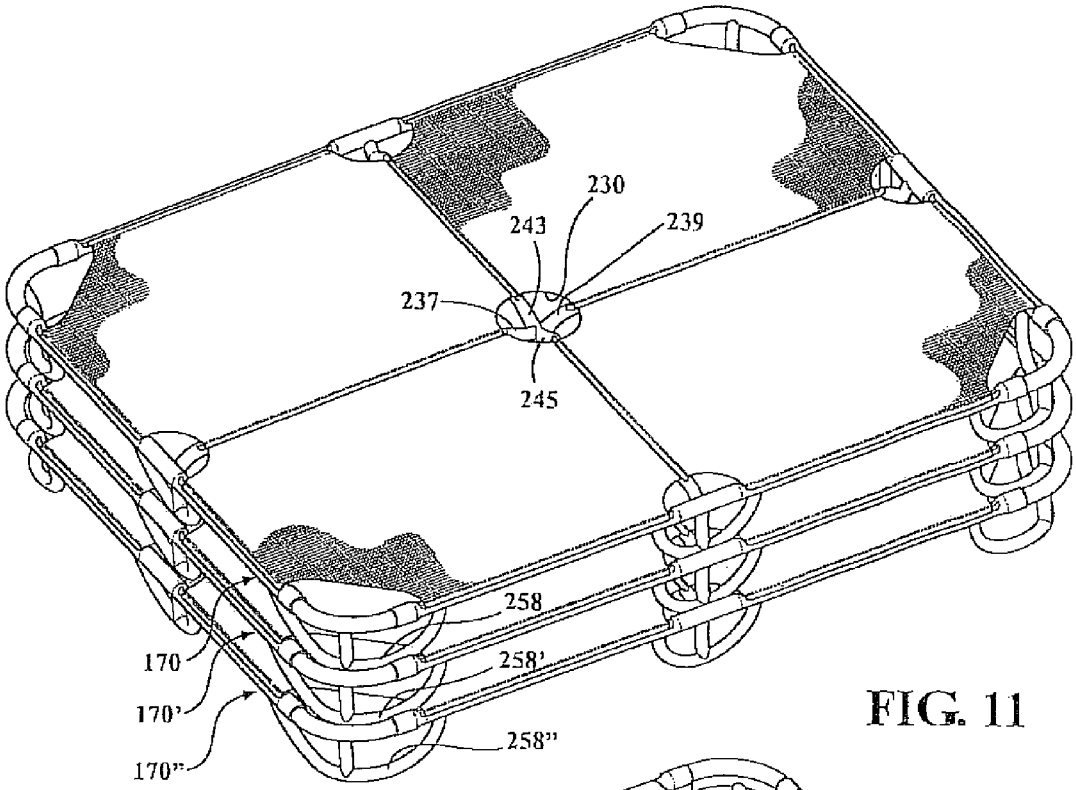
FIG. 11 is an illustration of the flattened pallet configuration of FIG. 8 in multiple stackable (non use) configuration.

Extending underneath each of the outer corner and intermediate perimeter gripping locations 172-186 are additional arcuate pedestals 246-260, each of which extends downwardly and partially (angularly) inwardly in the manner best depicted by selected corner pedestal 258 in FIG. 10 which also illustrates an associated intermediate vertical brace 262 (identical ones also being depicted for each succeeding and perimeter spaced corner and intermediate pedestal). In this fashion, and with reference to FIG. 11, a plurality of pallets 170, 170' and 170" can be stacked in the manner shown and by inwardly angled and bottom surface profiles of each pedestal 246-260 (and as further represented by stacked corner pedestals 258, 258' and 258") associated with a first pallet seating in inside abutting fashion relative to opposing aligning and inner edges of the grip portions 172-186 (with the reinforced arcuate perimeter reinforced edges 214-228 of the mesh covering 208 preventing interference with the inter-seating and vertically stacking/supporting locations. As further depicted in FIG. 11, the open interior perimeter 230 of the mesh 208, combined with the downwardly seating/pocket nature of four joining locations (see at 237, 239, 243 and 245 in each of FIGS. 9 and 11) arranged at the middle meeting locations of the subdivided inner members 236/238 and 242/243 best depicted in FIG. 9 (and which are arranged underneath the open circular reinforced mesh skirt 230 in FIG. 10), thus enables the middle pedestals 232 of each trampoline style pallet 170 to be supported at its middle in a likewise non-interfering fashion.

Figure 12:
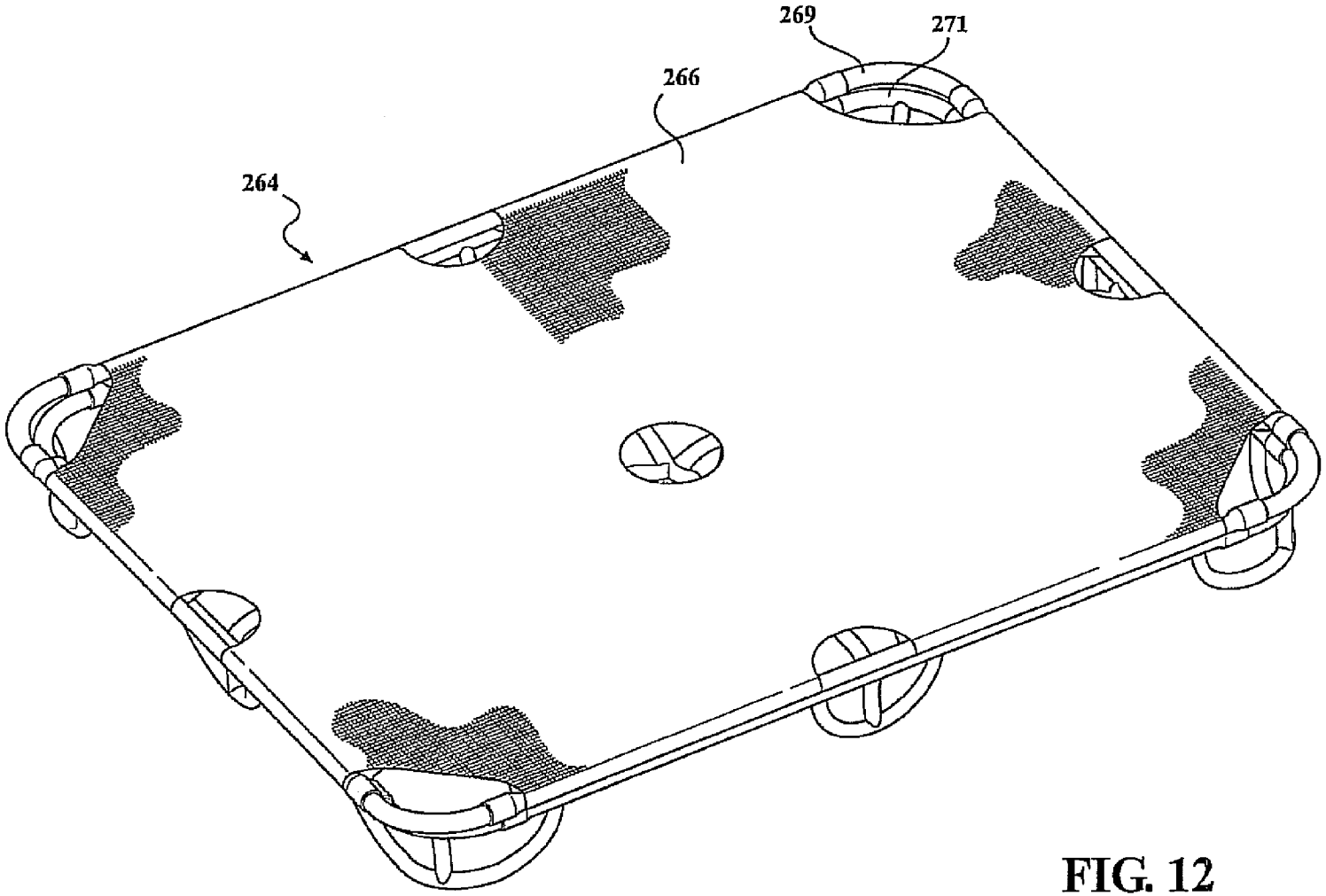
FIG. 12 is an illustration of a further variant of pallet similar to that shown in FIG. 8 and exhibiting a water dissipating and plasticized mesh.
Figure 13:
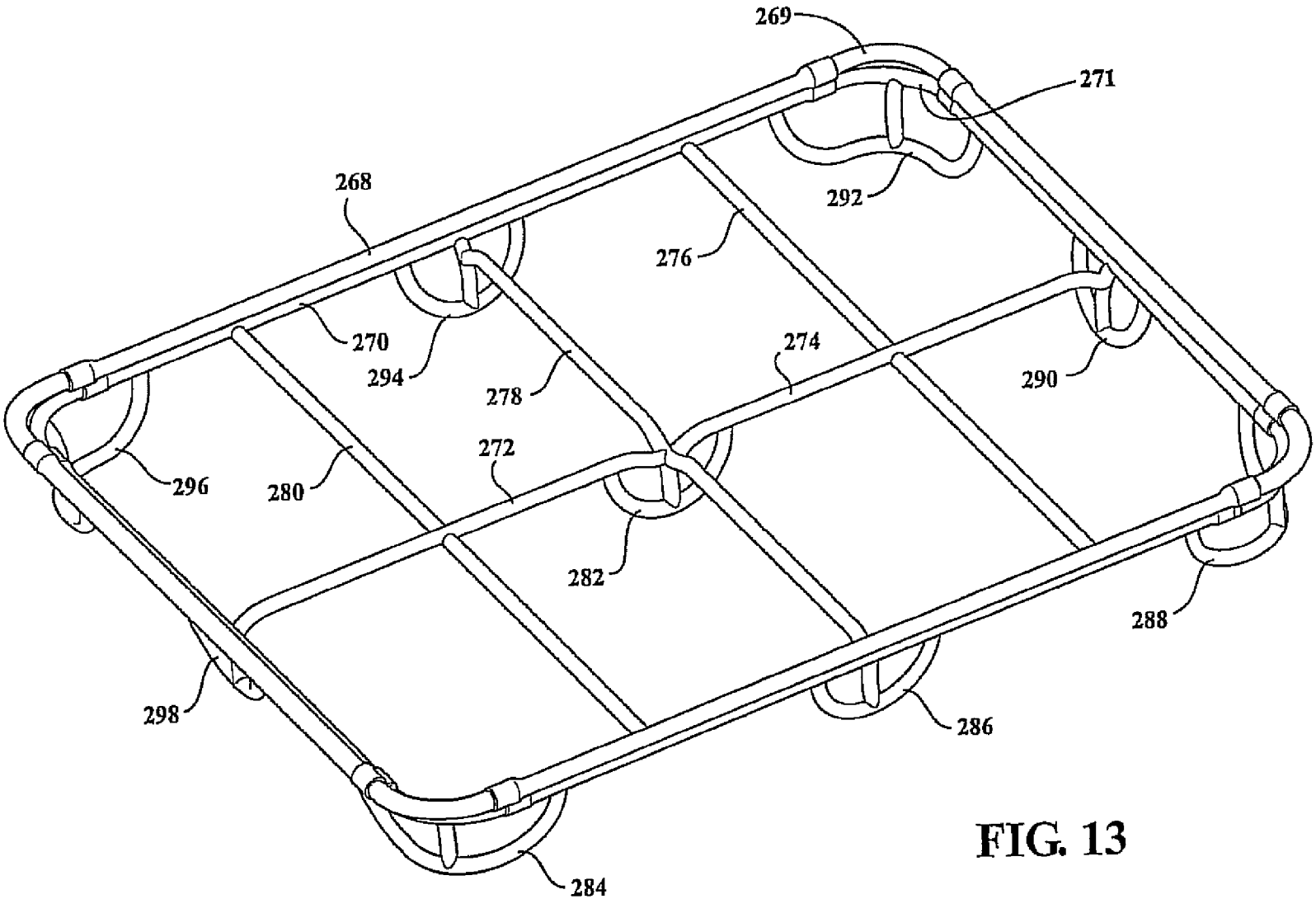
FIG. 13 is a skeletal depiction of the pallet in FIG. 12 with mesh covering removed.

Proceeding on to FIGS. 12 and 13, an illustration, is depicted generally at 264 of a further variant of pallet similar to that shown in FIG. 8 (such that identical, features are not separately numbered for purposes of ease of illustration) and exhibiting a water dissipating and plasticized mesh 266. Other differences from that depicted at 170 in FIG. 8 include the outer perimeter structure being subdivided into upper 268 and lower 270 overlapping and four sided/perimeter extending members (for purposes of ease of illustration each of the members 268 and 270 are identified as four sided and closed tubular profiles such mat separate identification of sides and corners is not necessary).

Figure 15:
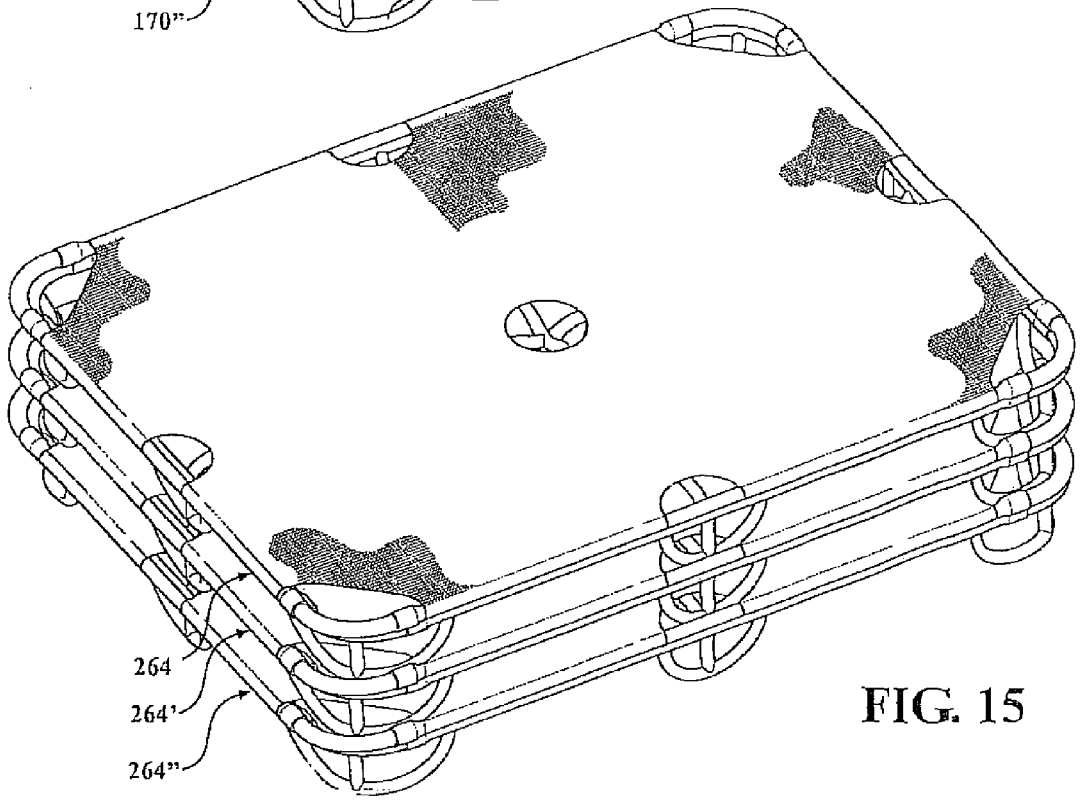
FIG. 15 is a stackable depiction of a plurality of pallets and better showing the notched and sealing nature established between the upper and lower surface locations of each pallet along with the cooperating aspect of the inwardly angled and corner situated standoffs.

Each of the four corner located profiles, further depicted by selected corner profile of the closed perimeter tubular members 268 and 270 as referenced at 269 and 271 in each of FIGS. 12 and 13, illustrate a separation gap. Otherwise, and referring to further FIG. 13, a similar arrangement of longitudinal inner and interconnecting extending supports 272/274 and additional crosswise interconnecting supports 276, 278 and 280 are provided and, in combination with identically configured inner arcuate pedestal 282 and outer perimeter spaced pedestals 284-298 (as compared to at 246-250 in FIG. 9) enable the pallets to be stacked in the fashion depicted at 264, 264' and 264" in FIG. 15.

Figure 14:
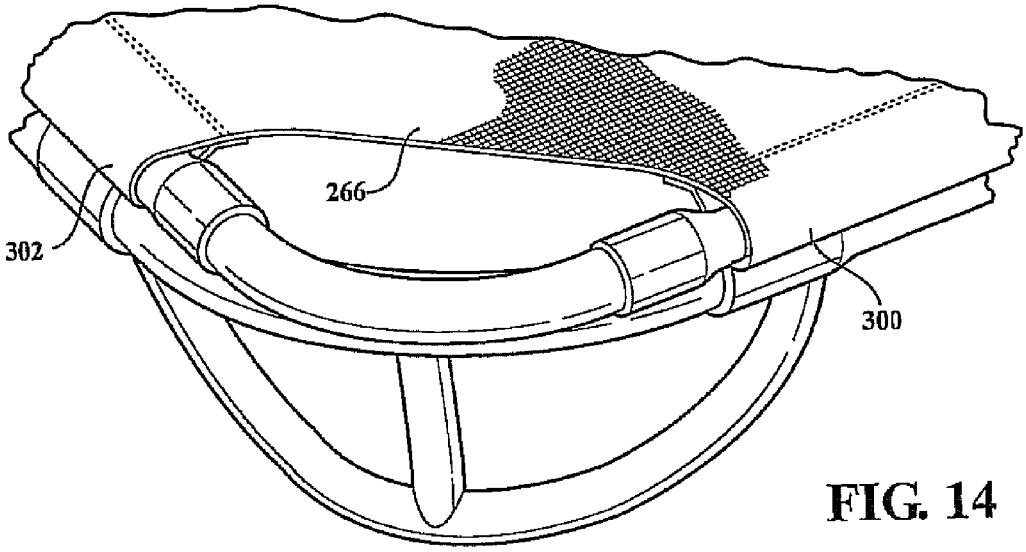
FIG. 14 is an enlarged partial corner view of the variant of FIG. 12.

As previously described, the separation gap established at each corner between the upper 268 and lower 270 perimeter spaced members (again represented at configured corner locations 269 and 271) facilitate the seating arrangement with opposing underside pedestal supports. FIG. 14 further best shows a selected pair of successive edge engaging loops 300 and 302 associated with the plasticized or other type (including again water dissipating) mesh 266, the looped edges including sewn or stitched as an alternative to the snap in mounting configuration previously described and in order to string the mesh 266 in a suitably cargo supporting and tautened configuration in combination with the underside and interior bracing supports associated with the skeletal construction of the trampoline style pallet.

Figure 16:
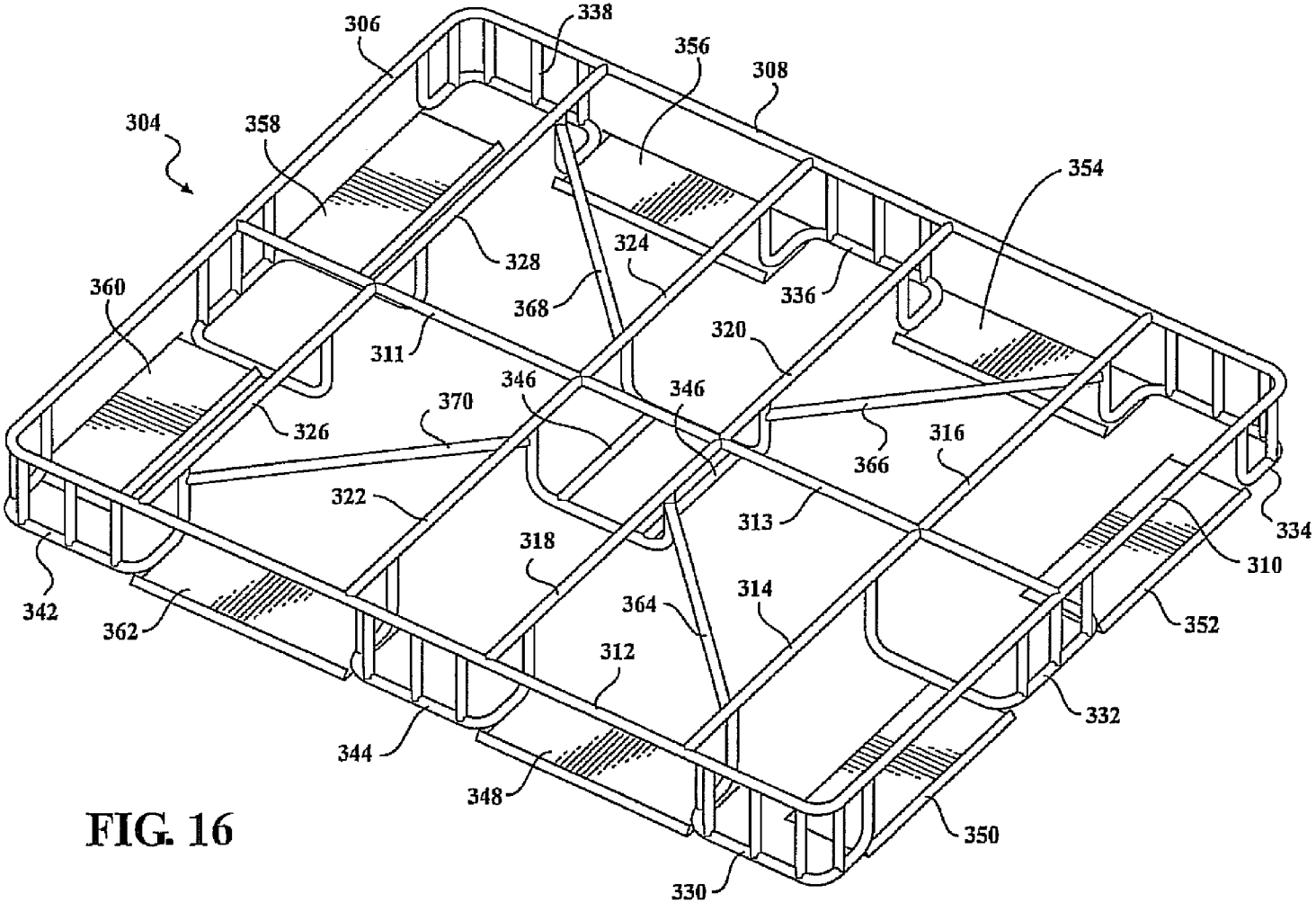
FIG. 16 is an illustration of a yet further variant of pallet exhibiting a tubular framework insert exhibiting any kind of metal, plastic or composite material.
Figure 17:
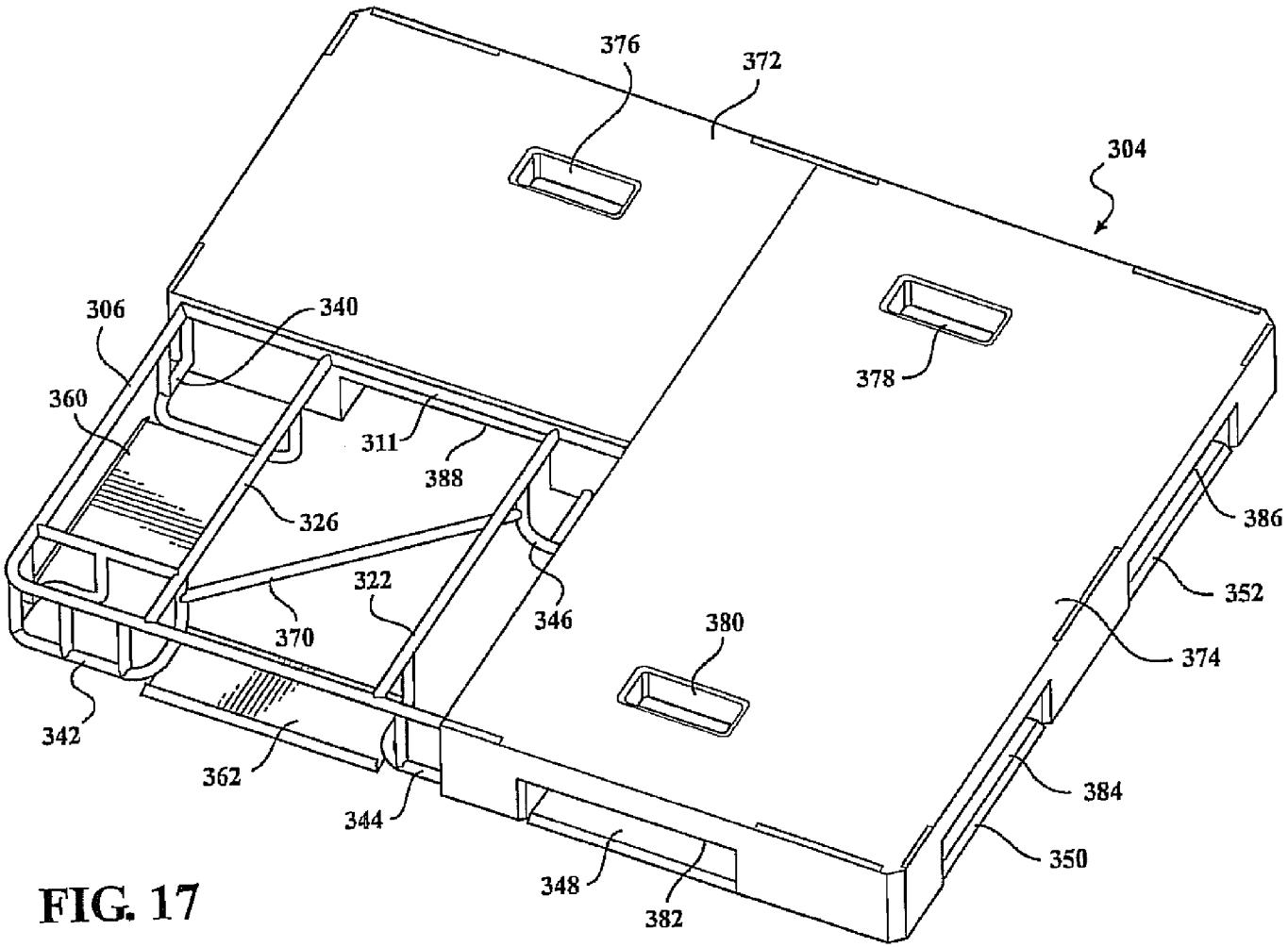
FIG. 17 is a successive perspective exhibiting a plastic or closed cellular foam or Styrofoam construction applied over the skeletal framework.

FIGS. 16-17 illustrate succeeding view of a yet further variant, generally at 304, of a pallet exhibiting a three dimensional structurally defining grid made up of interconnecting support members again including any of metal, plastic or composite materials. Referring initially to FIG. 16, a top rectangular surface includes a four sided outer perimeter defining member (such as including a single four sided member with individual interconnected sides 306, 308, 310 and 312).

A longitudinally extending inner support includes subdivided and interconnected portions 311/313, with additional inner extending and crosswise members include subdivided portions 314/316, 318/320, 322/324, 326/328. Depth defining underside locations include spaced apart pedestal stand off locations 330-344 and middle standoff 346. Base plates 348-362 are welded or otherwise secured to perimeter edge locations of the structure in alternating fashion with the underside stand off locations 330-344. Additional and diagonal extending supports 364-370 are provided for structurally reinforcing the assembly.

FIG. 17 is a successive perspective exhibiting exemplary molded subsections of either a plastic 372 or closed cellular foam 374 or Styrofoam construction, see as applied over the skeletal framework previously described. In molded handholds are depicted at locations 376 with the plastic coating section 272, as well as further at 378 and 380 with alternate (over) molded section 374. One contemplated over-molding process includes positioning the skeletal substrate of FIG. 16 within a mold interior in a desired arrayed fashion and prior to introducing the flowable material in a manner which defines a coated and level surface combined with underside recesses or cutouts (see at 382-388 at selected locations aligning with corresponding base plates and which provide forklift receiving apertures for facilitating lift and transport of the pallet).

Figure 18:
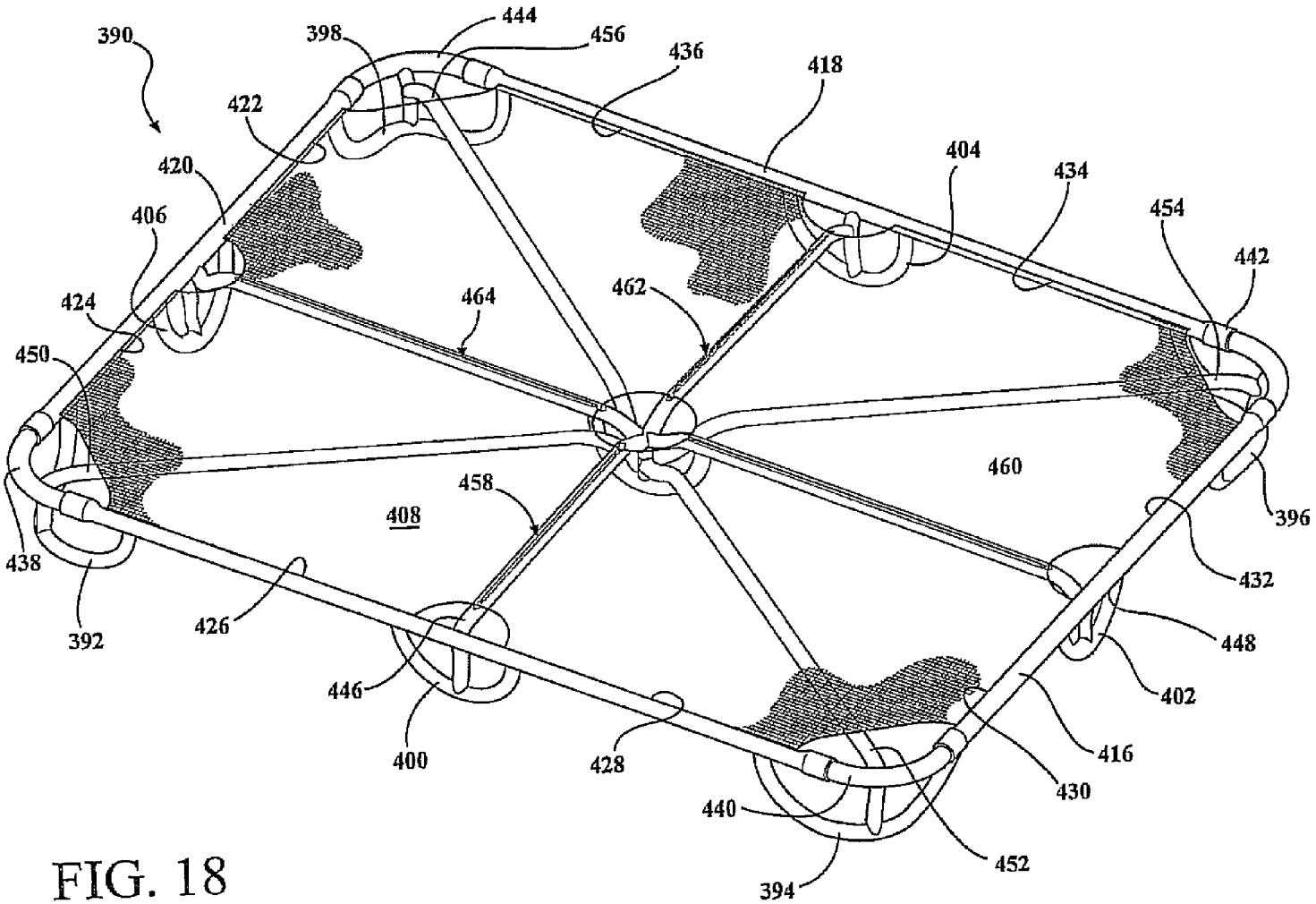
FIG. 18 is a perspective view of a further variant of pallet similar to that previously shown in FIG. 8, again exhibiting a substantially flattened and mesh supporting surface with corner and middle located standoff supports, and further disclosing an alternate mesh installation and tautening configuration incorporating a mesh looped end supporting inner tubular member which is inserted in coaxially installed fashion within a structural side defining outer member exhibiting a lengthwise extending and mesh receiving channel.

Referring now to FIG. 18, a perspective view is generally shown at 390 of a further variant of pallet similar to that previously shown in FIG. 8 (and which is generally of an identical overall construction and configuration such that a repetitive description is unnecessary). The pallet 390 again exhibits a substantially flattened and mesh supporting surface with corner 392, 394, 396 and 398 and alternating and middle 400, 402, 404 and 406 located standoff supports.

Figure 20:
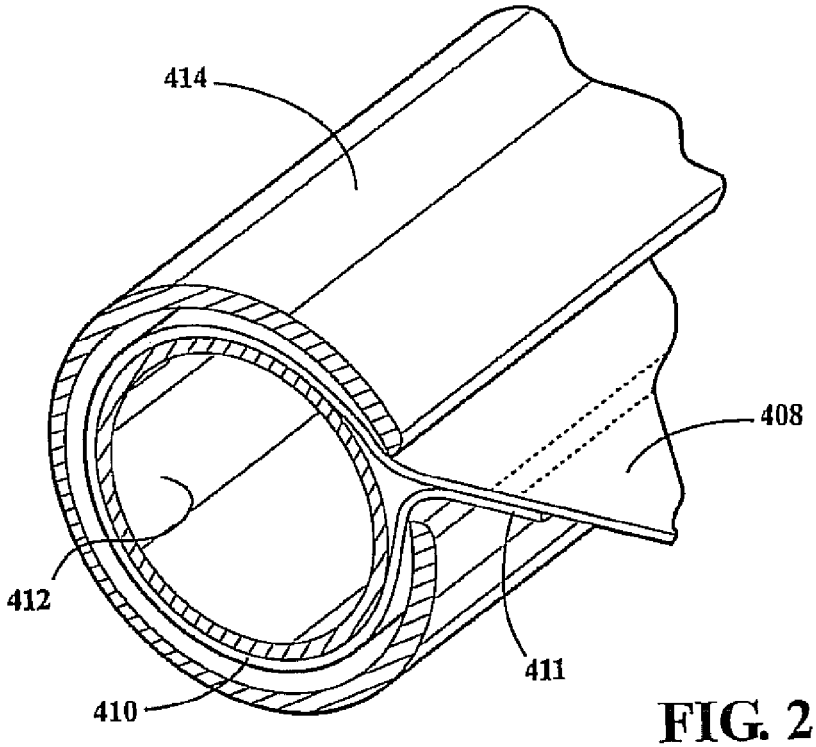
FIG. 20 is a succeeding view of FIG. 19 and depicting the outer and inner coaxial profile revealed by the removal of the corner profile section.

Also disclosed is an alternate installation and tautening protocol for installing a mesh material 408, this incorporating a mesh looped end (see as representatively shown in FIG. 20 by selected mesh extending looped edge 410 which is either stitched, sewn or otherwise heat staked or formed along each of a plurality of interconnecting edge locations of the mesh material 408). A plurality of inner tubular members, representatively shown by tubular member 412 in FIG. 20, are provided, with a given looped edge 410 receiving the tubular member 412 in internally sliding fashion.

Following insertion of the inner tubular members 412, each member 412 is coaxially installed within a structural side defining outer tubular member (each of four interconnected tubular members 414, 416, 418 and 420 being shown in FIG. 18 and representatively illustrated at 414 in FIG. 20). Each of the outer and structural tubular members 414, 416, 418 and 420 exhibit a pair of lengthwise spaced apart and extending and mesh receiving channel, respectively at 422/424, 426/428, 430/432 and 434/436. Also depicted are arcuate corner profile sections 438, 440, 442 and 444 which alternated with the elongated outer structural members 414, 416, 418 and 420 to create the four sided tubular framing replicating that previously depicted in FIG. 8.

In order to install the mesh material 408, the arcuate corner sections are removable, following which the inner tubular members (again representative of that shown in FIG. 20 at 412, is coaxially inserted within a selected outer structural tube (in FIG. 20 again shown at 414) with the mesh looped edge 410. A joined location (see at 411 in FIG. 20) of the mesh between the main body 408 and the looped end 410 is threaded or otherwise passed through each channel 424 (this can also consist of a single continuous channel extending the overall lengths of each outer structural members 414, 416, 418 and 420), and in order to assemble the mesh material 408 around the four outer interconnecting sides.

Figure 19:
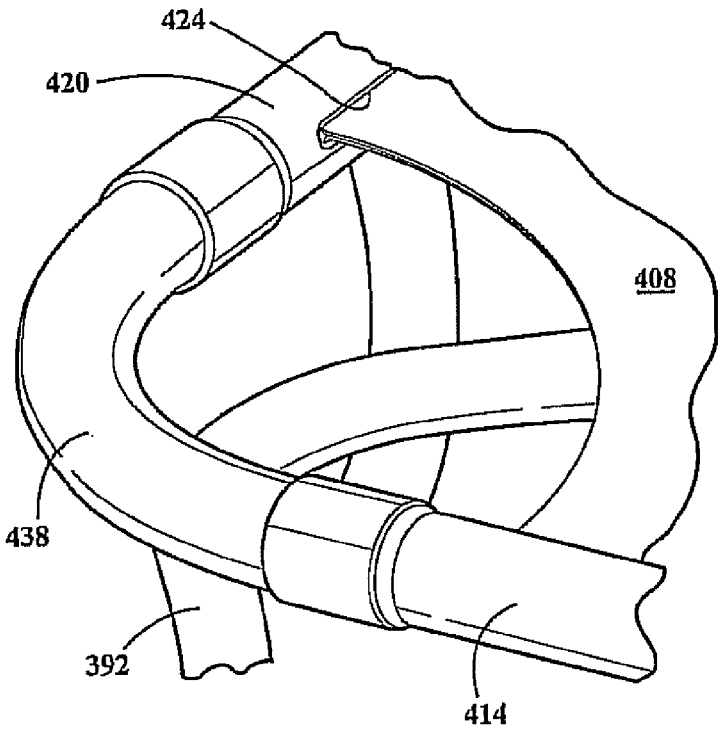
FIG. 19 is an enlarged corner partial view of the tubular profile associated with the pallet frame construction of FIG. 18 and further showing the arcuate corner profile section which is removable in order to reveal the outer structural supporting and inner coaxially inserting tubular members.
Figure 21:
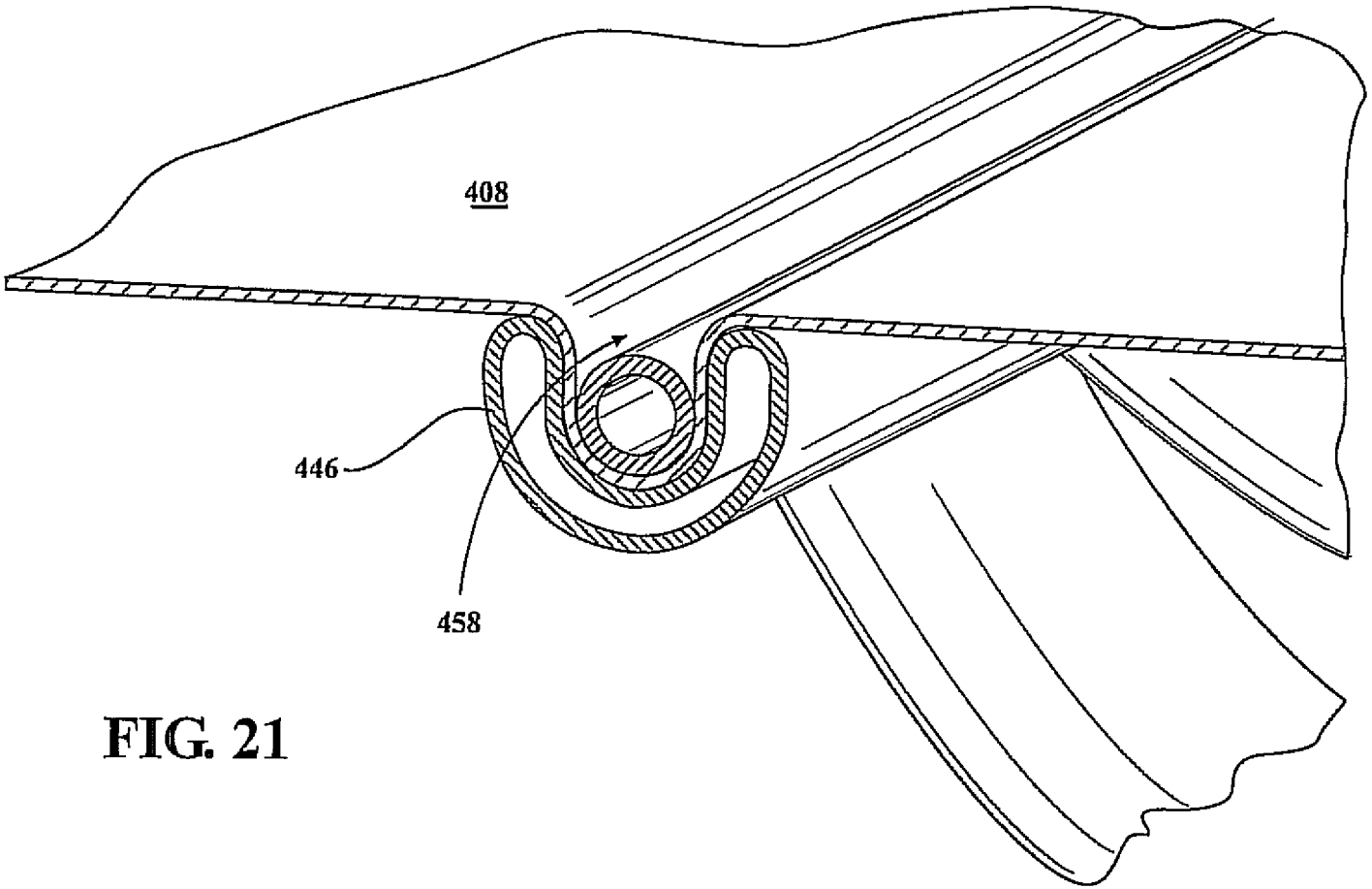
FIG. 21 is an enlarged side looking perspective of a reinforcing intermediate extending and outer structural supporting tubular member exhibiting an upper facing and elongate receiving channel, similar to that associated with the side extending outer tubular depicted in FIGS. 18-20, and in order to establish a structural supporting and tautening condition for the mesh material along interior extending locations of the pallet construction.

Finally, FIG. 21 is an enlarged side looking perspective of a reinforcing intermediate extending and outer structural supporting tubular member (reference is again made to FIG. 18 which, in partially transparent fashion, depicts inner grid-wise extending members 446 and 448 in addition to other cross-wise grid members 450, 452, 454 and 456, each of these extending between selected outer tubular members 414-420. The selected inner members 446 and 448, as further depicted in FIG. 21 by selected member 446, exhibits an upper facing and elongate receiving channel 458, similar to that associated with the side extending outer tubular depicted in FIGS. 18-20, and in order to establish a structural supporting and tautening condition for the mesh material 408 along interior intermediate extending locations of the pallet construction.

This is further shown in FIG. 18 and by which the mesh 408 is tautened both around the four outer edges as well as inwardly along each of four identified channel profiles 458, 460, 462 and 464. It is further understood that other tautening and/or mesh pinching configurations, beyond those disclosed, are also envisioned and which can be implemented in order to provide a firm support surface to the pallet construction.

Having described my invention, other and additional preferred embodiments will become apparent to those skilled in the art to which it pertains, and without deviating from the scope of the appended claims.

I claim:

1. A pallet, comprising:

a body having a frame construction and including a plurality of interconnected and structural outer tubular members with alternating and corner arcuate shaped portions which collectively assemble to receive a mesh material to define an upper support surface, said mesh material having folded edge extending portions which are fitted within elongate extending recessed profiles defined in said outer tubular members;

an elongate rod resistive fitting within each of said recessed profiles in order to pinch said folded edge portions such that said mesh material is progressively installed along each of said interconnected and outer extending perimeter edges of said interconnected structural members in a tautened and load supporting fashion;

a plurality of stand-offs extending from underside projecting locations of said body in order to elevate said bottom an upward distance from a ground supporting location; and spaced apart and arcuate recessed perimeter extending edges of said mesh material located at intermediate and corner locations of said body in alternating fashion with said folded and engaging edge extending portions, said recessed perimeter edges located in proximity to said plurality of stand-offs in order to facilitate multiple stack-ability of said bodies.

2. The pallet as described in claim 1, further comprising at least one inner extending tubular member extending between said outer tubular members and exhibiting at least one additional, upper facing and elongate receiving channel for receiving an intermediate looped portion of the mesh material along interior intermediate extending locations of the pallet construction, at least one additional resistive fitting rod inserting into said additional receiving channel.

3. The pallet as described in claim 1, said body further comprising an additional stand-off at an interior location of said frame construction, an aperture in said mesh material defined by an inner perimeter edge overlaying said additional stand-off.

* * * * *